US006945644B2

(12) United States Patent
Kabalnov

(10) Patent No.: US 6,945,644 B2
(45) Date of Patent: Sep. 20, 2005

(54) THERMALLY INDUCED PHASE SEPARATION TO RECOVER INK-JET PEN

(75) Inventor: Alexey S Kabalnov, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 54 days.

(21) Appl. No.: 10/627,150

(22) Filed: Jul. 24, 2003

(65) Prior Publication Data

US 2005/0018025 A1 Jan. 27, 2005

(51) Int. Cl.[7] ..... B41J 2/01
(52) U.S. Cl. ..... 347/100; 347/95; 347/73
(58) Field of Search ..... 347/100, 95, 96, 347/73, 43, 29, 101; 106/31.6, 31.13, 31.27; 523/160

(56) References Cited

U.S. PATENT DOCUMENTS

| | | | | |
|---|---|---|---|---|
| 5,643,357 | A | 7/1997 | Breton et al. | |
| 6,422,676 | B1 | 7/2002 | Torgerson et al. | |
| 6,443,551 | B1 * | 9/2002 | Matsumoto | 347/100 |
| 6,578,958 | B2 * | 6/2003 | Gotoh et al. | 347/100 |
| 2002/0109764 | A1 | 8/2002 | Hale et al. | |

FOREIGN PATENT DOCUMENTS

| | | | |
|---|---|---|---|
| EP | 0 767 225 A2 | 4/1997 | |
| EP | 1 093 918 | 4/2001 | |
| EP | 1 122 288 A1 | 8/2001 | |
| JP | 10-279869 | * 10/1998 | B41J/2/01 |

OTHER PUBLICATIONS

J.C. Ravey, et al; "Properties of fluorinated non–ionic surfactant–based systems and comparison with non–florinated systems", Colloids and Surfaces A: Physicochemical and Enginnering Aspects, 84(1994), pp 11–31.

M. Kahlweit, et al; Phase behavior on ternary systems of the type H20–Oil–Nonionic amphiphile (microemulsions), Angew. Chem. Int. Ed. Engl. 24(1985), pp 654–668.

G. Karlstrom; "A new model for upper and lower critical solution temperatures in Poly(ethylene oxide) solutions"; J. Phys. Chem., 1985, (89), pp 4962–4964.

Kozo Shinoda et al, "Emulsions and Solubilization" pp. 32–53.

* cited by examiner

*Primary Examiner*—Manish S. Shah

(57) ABSTRACT

The present invention relates to a method and system for forming a protective cushion to slow down evaporation and prevent clogging in an inactive ink-jet printhead by a) heating ink-jet ink in the at least one ink firing chamber, the ink separating into an organic surfactant phase and an ink colorant phase; and b) forming the protective cushion at the at least one nozzle by allowing the organic surfactant phase to settle as a layer covering the opening of the at least one nozzle in the at least one ink firing chamber.

30 Claims, 2 Drawing Sheets

THERMALLY INDUCED PHASE SEPARATION TO RECOVER INK-JET PEN

FIELD OF THE INVENTION

The field relates to forming a protective cushion to slow down evaporation and prevent clogging in an inactive ink-jet printhead.

BACKGROUND OF THE INVENTION

It is well known that when an ink-jet pen is stored in an inactive state, the nozzles often clog with crusted ink components. This constitutes the pen recovery problem.

There are many recovery algorithms that help to alleviate the problem, for example, the ink firing chamber of the pen can be heated and the inks can be repeatedly spit in a spittoon, with intermittent wiping of the pen (sometimes, with a solvent such as glycerol or polyethylene glycol (PEG)). Alternatively, the pen can be actively primed by a pump. Also, adding co-solvents (humectants) and surfactants helps to slow down crusting of ink components by reducing evaporation, such cosolvents and surfactants occasionally even forming a soft gel plug of the solvent at the nozzle. All of these ways of dealing with the pen recovery problem are either time-consuming, not consistently effective or both.

SUMMARY OF THE INVENTION

The present invention relates to a method of forming a protective cushion to slow down evaporation and prevent clogging in an inactive ink-jet printhead, the inactive ink-jet printhead comprised of at least one ink firing chamber having an opening to at least one nozzle, the method comprising the steps of:

a) heating ink-jet ink in the at least one ink firing chamber, the ink separating into an organic surfactant phase and an ink colorant phase; and b) forming the protective cushion at the opening to the at least one nozzle by allowing the organic surfactant phase to settle as a layer on the opening of the at least one nozzle in the at least one ink firing chamber.

The present invention also relates to a system to slow down evaporation and prevent clogging in an inactive ink-jet printhead by forming a protective cushion covering an opening of at least one ink-jet nozzle in at least one ink firing chamber, the at least one ink firing chamber comprising:

a) a heating system adapted to heat ink-jet ink in the at least one ink firing chamber, the ink separating into an organic surfactant phase and an ink colorant phase; and b) a protective cushion-forming system operative to form the protective cushion from the organic surfactant phase settling as a layer on the opening of the at least one nozzle in the at least one firing chamber.

DETAILED DESCRIPTION OF EMBODIMENTS OF THE INVENTION

Figure 1:
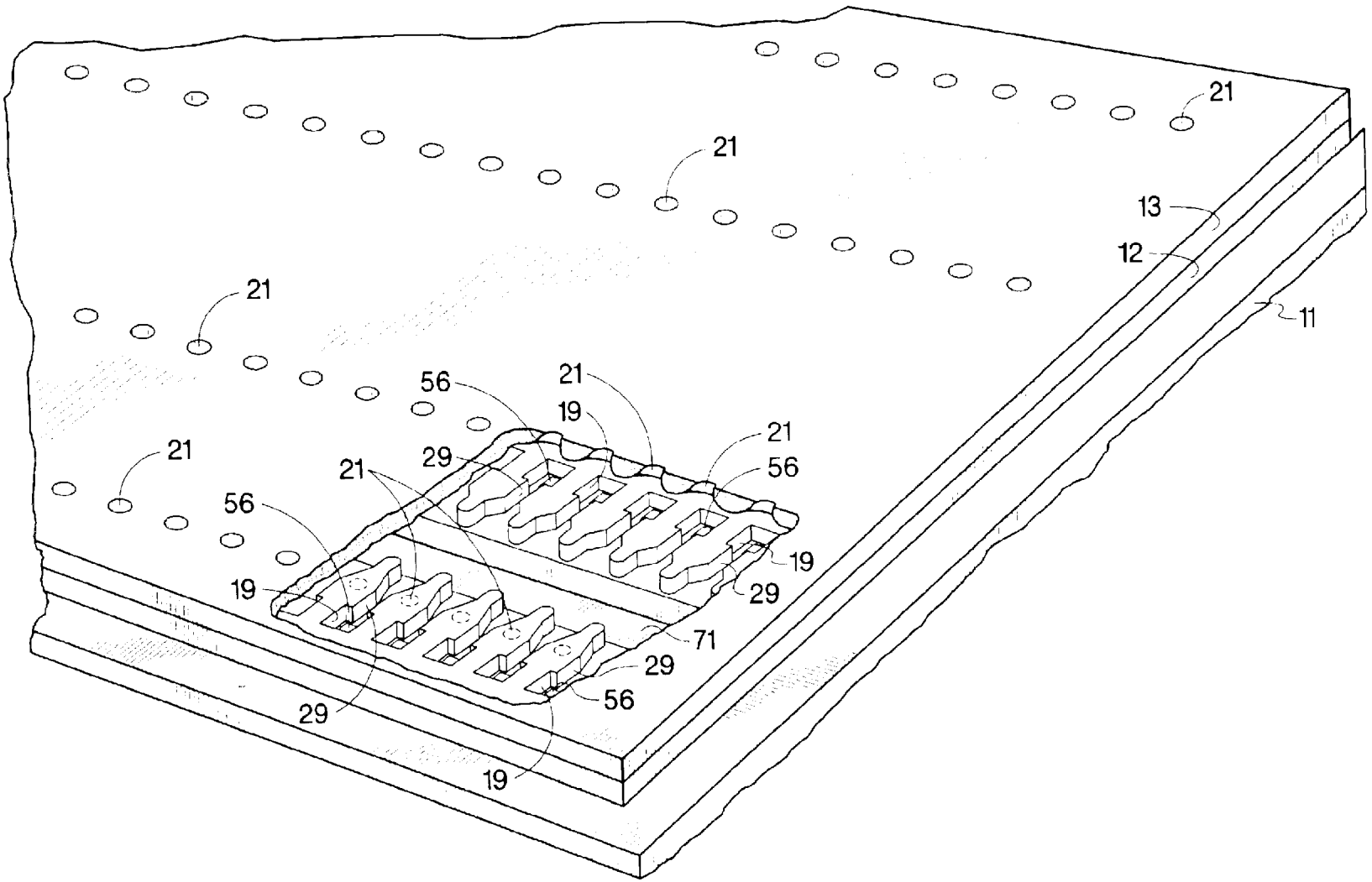
FIG. 1 is a schematic, partially broken away perspective view of a portion of an embodiment of an ink jet printhead.

Recovering an ink-jet pen that has been stored in an inactive state is often made difficult because of the problem of clogged nozzles. It is known that colorants, either dyes or pigments, as well as polymers and inorganic salts, are prone to form a hard, solid plug that is not spittable from the nozzle. It is especially desirable to be able to deplete the ink firing chamber of those crusting components when the pen is taken from the printer for uncapped storage or is stored capped for a long time.

The present inventor has discovered a way to induce the formation of an organic cushion covering the nozzle in an ink firing chamber by the separation of the ink vehicle from the ink colorant in either dye-based or pigment-based ink. This is done by the abrupt heating up of the ink firing chamber to the point at which the ink vehicle phase separates into two layers. The lower layer, more dense than the upper layer, is formulated in such a way that it shows poor solubility for crusting components in the inks and has a low viscosity and vapor pressure. It thus serves as a protective layer or cushion that will slow down the evaporation from the pen, as well as, in the case of pigment-based inks, stop pigment from settling in the bottom layer.

There are many solvents/surfactants used in ink-jet that tend to phase, separate from water at elevated temperatures, in particular, solvents having ethylene oxide/propylene oxide groups. This is known in ink/surfactant technology as "clouding". The counter-intuitive behavior (that is, the decrease in solubility with increasing temperature) stems from the peculiar properties of poly(ethylene oxide) and poly(propylene oxide) polymer chains (G. Karlstrom, J. Phys. Chem., V. 89, pp 4962–4964, 1985). When aqueous solutions of surfactants containing a poly(ethylene oxide) polar head and an alkyl tail, e.g., polyethoxylated alcohols, are heated up, the solutions separate into two phases, one being surfactant-rich (called below the surfactant phase), and the other being water-rich, called below the aqueous phase. The dependence of the cloud point on the lengths of poly(ethylene oxide) and alkyl chain in the surfactant molecule is well understood, in particular, shorter-alkyl-chain and longer ethylene oxide chain surfactants tend to cloud at higher temperatures (K. Shinoda and S. Friberg, Emulsions and Solubilization, John Wiley & Sons, 1986). Similarly, clouding temperature can be adjusted by adding co-surfactants, co-solvents, oils and electrolytes (M. Kahlweit R. Strey, Angew. Chem., Int. Ed. Engl., v. 24, p 654, 1985).

"Clouded" solutions of surfactants tend to separate with time into two distinct layers. Whether or not the surfactant phase forms on the top or on the bottom depends on the relative densities of the surfactant and water. Typically, hydrocarbon surfactants are less dense than water and the surfactant phase forms on the top. However, if the surfactant contains atoms with higher atomic weight, such as fluorine, chlorine or bromine, the surfactant layer will form on the bottom. The density of the surfactant phase can be additionally adjusted by solubilizing some amount of an oil in the surfactant. Again, hydrocarbon oils tend to have a density that is lower than that of water. On the other hand, halocarbons such as chloro, fluoro and bromocarbons tend to be more dense than water and can increase the density of the surfactant phase.

In the preferred embodiment of this invention, the solubility of dyes/pigments in the surfactant phase should be carefully adjusted in such a way that the colorant is depleted from the surfactant phase. Typically the dyes/pigments, as well as inorganic salt additives used in ink-jet are water-soluble and are expected to be depleted from the surfactant phase that overall has a more hydrophobic environment than the aqueous solution.

In thermal ink-jet, the ink drop ejection in the ink firing chamber is caused by the abrupt heating and boiling of the ink on a resistor. It also has been known in the art that the resistors can be utilized for increasing the temperature in the firing chamber without causing the drop ejection, known as pulse warming.

Pulse warming is a technique used to warm the printhead temperature before printing and maintain it during printing thereby ensuring consistent drop volume. Pulse warming uses the same hardware that is used to fire the printhead during printing with one important difference—the pulse width is too small to cause ink to eject, as described in e.g., EP 1093918A2.

There are several commercial ink-jet inks that tend to cloud at elevated temperatures. For example, color inks used in 700–800 series Deskjet printers produced by Hewlett Packard cloud between about 40 and 95° C. Clouding of inks at these temperatures as such does not preclude them from being used in thermal ink-jet, insofar as the normal temperature of the firing chamber remains below the cloud point. This is despite the fact that inks can get as hot as 200° C. without clouding when the turn on energy (TOE) is applied to the resistor in the ink chamber during the firing event. The firing event does not cause a clouding problem, because clouding does not have enough time to develop during the interval that the ink chamber temperature is at 200° C.

Such ink clouding at 40–95° C., as described above, can be artificially induced by pulse-warming the ink chamber for several seconds. This should be avoided during the normal pen cycle. However, the inventor has found that sending voltage below the turn-on energy to the resistor for several seconds to obtain an ink chamber temperature of 40–95° C., and in a preferred embodiment, 60–80° C., induces the separation of ink-jet ink to form a protective cushion of the organic surfactant phase of the ink solvents which covers the inner opening of the nozzle. This protective cushion on the nozzle prevents evaporation and crusting during the time the inkjet printhead is inactive and can be spit out of the nozzle when printing activity of the printhead resumes.

FIG. 1 is a schematic partially broken away perspective view of a non-limiting embodiment of an inkjet printhead, specifically showing the structure of an ink chamber including various structures related to the present invention. Referring to FIG. 1, the ink chambers 19 are more particularly disposed over respective ink firing heater resistors 56, and each ink chamber 19 is defined by interconnected edges and walls of a chamber opening formed in the barrier layer 12 which is laminated to the thin film substructure 11. The ink channels 29 are defined by further openings formed in the barrier layer 12, and are integrally joined to respective ink firing chambers 19. The ink channels 29 open towards a feed edge of an adjacent ink feed slot 71 and receive ink from such ink feed slot. The orifice plate 13 includes orifices or nozzles 21 disposed over respective ink chambers 19, such that each ink firing heater resistor 56, an associated ink chamber 19, and an associated orifice 21 are aligned.

In one embodiment of the present invention, an inkjet printer is built so that if the user opens the printer lid or the pen compartment latch, it activates a switch in the printhead. The switch switches on the resistors in the ink chambers. The resistors heat up and induce a phase separation of the ink in the ink chamber. The low vapor pressure solvent settles down at the nozzle bore and forms a protective "cushion" that is substantially devoid of the crusting components of the ink. By this means, the pen is prepared for storage. When the pen is inserted again for printing, the "cushion" is spit out.

In an alternative embodiment, an inkjet printer is built so that if the pen is passive for some time, e.g., 30 minutes of sitting on the cap without printing, the printer heats up the pen and the makes the organic solvent "cushion" at the bottom of the nozzle.

In an embodiment when pigmented ink is used, it is beneficial to prevent the pigment from the ink from settling in the ink chamber by adjusting the density of the cushion so that it is greater than the density of the pigment particles.

Figure 2:
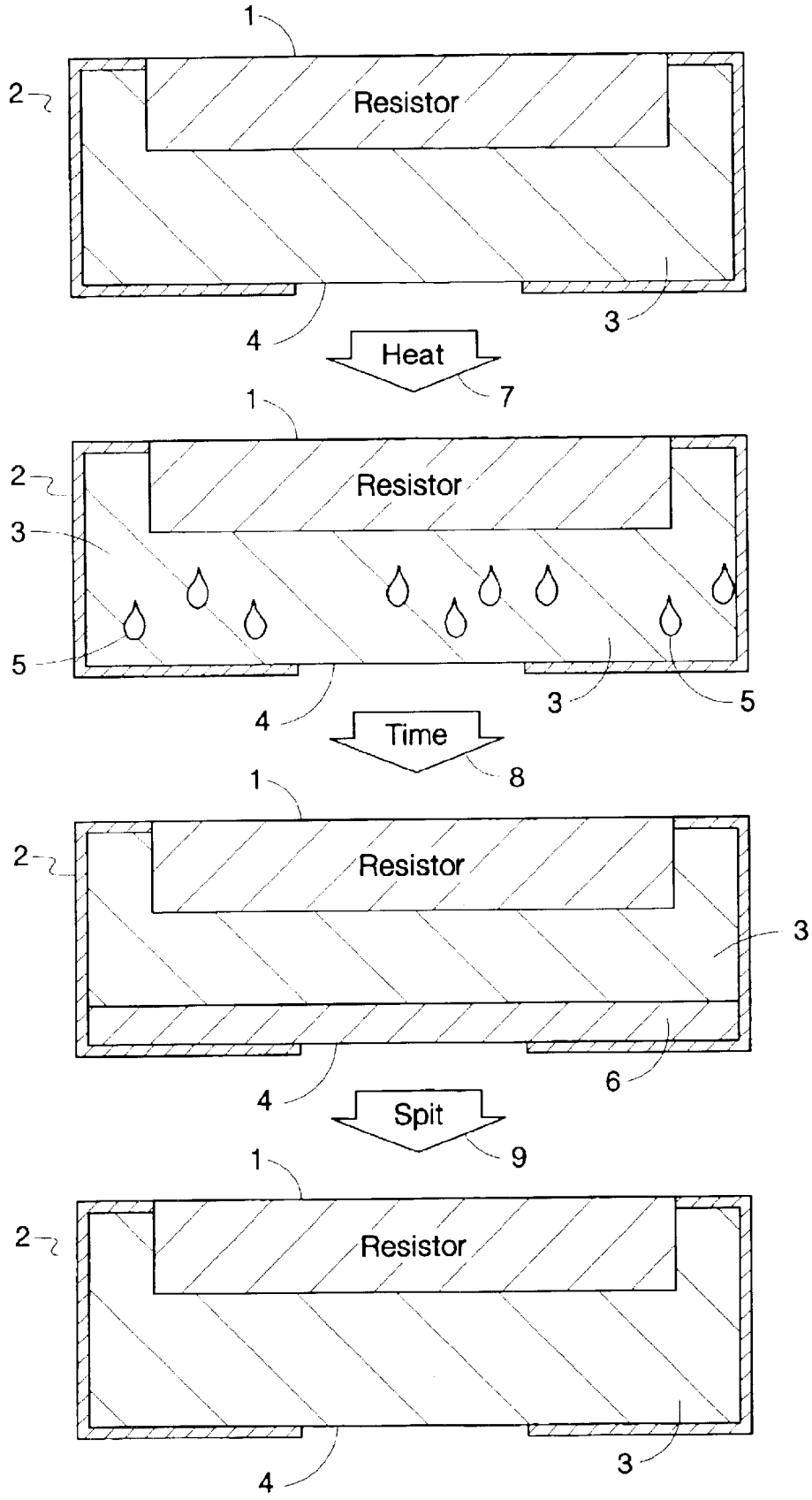
FIG. 2 shows an embodiment of the invention having a series of four cross section views of one ink firing chamber as the chamber progresses through the steps of the present invention.

FIG. 2 shows four different stages in a side view of an ink firing chamber 2 in the present invention. In each stage can be seen the resistor 1 connected to the top inside surface of the chamber 2 and the nozzle 4 which consists of an opening between the inside and outside of the chamber 2 at the bottom of the chamber 2. Each stage also shows the presence of ink 3 inside the chamber 2. Between the first and second stages, the chamber 2 is heated 7. In the second stage, drops 5 of organic phase appear in the ink 3. Between the second and third stages time 8 passes. In the third stage the drops 5 of organic phase have formed a protective cushion 6 at the bottom of the chamber 2, covering the nozzle 4 opening. Between the third and fourth stage, the protective cushion 6 has been spit 9 out of the ink chamber 2. The fourth stage appears as before in the first stage, with ink 3 in the chamber 2 without drops 5 of organic phase or cushion 6.

In a preferred embodiment, solvents that can be used in the ink can be chosen especially for their enhancement of the organic cushion forming process. Solvents selected from poly(ethylene oxide) derivatives and poly(propylene oxide) derivatives have been found to be effective. Low polarity oils such as hydrocarbons, fluorocarbons and siloxanes can also be used effectively. In addition, surfactants selected from the group consisting of hydrocarbon surfactants, fluorocarbon surfactants and siloxane surfactants can also be chosen. Various fluorinated solvents and solvents derivatized from siloxane are also effective because they are relatively poor solvents for dyes or pigments.

Also in a preferred embodiment of the present invention, the organic surfactant phase of the ink has a density above 1.1 g/cm$^3$ and the ink colorant phase should have a lower density than the ink vehicle phase. In this preferred embodiment the organic surfactant tends to settle in the ink firing chamber while the ink vehicle phase floats above.

EXAMPLES

Example 1

The following yellow ink has been prepared by mixing the components in a test-tube:

| Component | Amount |
|---|---|
| Acid yellow 17 (Sensient) | 3.1 wt % |
| Tergitol 15S9 (Aldrich Chemical) | 1.6 wt % |
| Dowfax 8390 (Dow Chemical) | 0.32 wt % |
| Carbon tetrachloride | 1 v/wt % |
| Water | Balance |

The ink were homogeneous and transparent as judged visually. The inks were gradually heated on the water bath in a 5-ml test-tube. The ink showed clouding at 45 C with the organic phase forming at the bottom of the test-tube. The phase was depleted in the yellow dye, as judged visually.

What is claimed is:

1. A method of forming a protective cushion to slow down evaporation and prevent clogging in an inactive ink-jet printhead of a thermal ink-jet printer, the inactive ink-jet printhead comprised of at least one ink firing chamber having an opening to at least one nozzle, the method comprising the steps of:

a) heating ink-jet ink in the at least one ink firing chamber to a temperature from 40° to 95° C., the ink separating into an organic surfactant phase and an ink colorant phase; and b) forming the protective cushion at the opening to the at least one nozzle by allowing the organic surfactant phase to settle as a layer on the opening of the at least one nozzle in the at least one ink firing chamber.

2. The method of claim 1, wherein the heating of the ink-jet ink is by sending voltage through at least one resistor in the at least one ink firing chamber.

3. The method of claim 1, wherein the heating of the ink-jet ink is to a temperature from 60° to 80° C.

4. The method of claim 1, wherein ink colorant in the ink colorant phase is selected from the group consisting of dye and pigment.

5. The method of claim 1, wherein the organic surfactant phase is depleted of the colorants in the ink colorant phase.

6. The method of claim 1 wherein the ink-jet ink comprises inorganic salts.

7. The method of claim 6, wherein the organic surfactant phase of the ink-jet ink is depleted of the inorganic salts.

8. The method of claim 1, wherein the protective layer is expelled out of the at least one nozzle when the ink-jet printhead restarts printing ink through the at least one nozzle.

9. The method of claim 1, wherein the organic surfactant phase comprises solvents selected from the group consisting of poly(ethylene oxide) derivatives and poly(propylene oxide) derivatives.

10. The method of claim 1, wherein the organic surfactant phase comprises low polarity oils selected from the group consisting of hydrocarbons, halocarbons and siloxanes.

11. The method of claim 1, wherein the organic surfactant phase comprises surfactants selected from the group consisting of hydrocarbon surfactants, halocarbon surfactants and siloxane surfactants.

12. The method of claim 1, wherein the organic surfactant phase comprises halogenated solvents.

13. The method of claim 1, wherein the organic surfactant phase comprises solvents derivatized from siloxane.

14. The method of claim 1, wherein the organic surfactant phase has a density above 1.1 g/cm$^3$.

15. The method of claim 1, wherein the ink colorant phase has a lower density than the organic phase.

16. A system to slow down evaporation and prevent clogging in an inactive ink-jet printhead of a thermal ink-jet printer by forming a protective cushion covering an opening of at least one ink-jet nozzle in at least one ink firing chamber, the at least one ink firing chamber comprising:

a) a heating system adapted to heat ink-jet ink in the at least one ink firing chamber to a temperature from 40° to 95° C., the ink separating into an organic surfactant phase and an ink colorant phase; and b) a protective cushion-forming system operative to form the protective cushion from the organic surfactant phase settling as a layer on the opening of the at least one nozzle in the at least one ink firing chamber.

17. The system of claim 14, wherein the heating of the ink-jet ink is by sending voltage through at least one resistor in the at least one ink firing chamber.

18. The system of claim 14, wherein the heating of the ink-jet ink is to a temperature from 60° to 70° C.

19. The system of claim 14, wherein ink colorant in the ink colorant phase is selected from the group consisting of dye and pigment.

20. The system of claim 14, wherein the organic surfactant phase is depleted of the colorants in the ink colorant phase.

21. The system of claim 14, wherein the ink-jet ink comprises inorganic salts.

22. The system of claim 21, wherein the organic surfactant phase of the ink-jet ink is depleted of the inorganic salts.

23. The system of claim 14, wherein the protective layer is expelled out of the at least one nozzle when the ink-jet printhead restarts printing ink through the at least one nozzle.

24. The system of claim 14, wherein the organic surfactant phase comprises solvents selected from the group consisting of poly(ethylene oxide) derivatives and poly (propylene oxide) derivatives.

25. The system of claim 14, wherein the organic surfactant phase comprises low polarity oils selected from the group consisting of hydrocarbons, halocarbons and siloxanes.

26. The system of claim 14, wherein the organic surfactant phase comprises surfactants selected from the group consisting of hydrocarbon surfactants, halocarbon surfactants and siloxane surfactants.

27. The system of claim 14, wherein the organic surfactant phase comprises halogenated solvents.

28. The system of claim 14, wherein the organic surfactant phase comprises solvents derivatized from siloxane.

29. The system of claim 14, wherein in the organic surfactant phase has a density above 1.1 g/cm$^3$.

30. The system of claim 14, wherein the ink colorant phase has a lower density than the organic surfactant phase.

* * * * *